US007308883B2

(12) United States Patent
Suzuki

(10) Patent No.: US 7,308,883 B2
(45) Date of Patent: Dec. 18, 2007

(54) VEHICULAR ACCESSORY DRIVING APPARATUS

(75) Inventor: Makoto Suzuki, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/951,911

(22) Filed: Sep. 29, 2004

(65) Prior Publication Data

US 2005/0079949 A1 Apr. 14, 2005

(30) Foreign Application Priority Data

Oct. 8, 2003 (JP) ..... 2003-349755

(51) Int. Cl.
*F02B 77/08* (2006.01)

(52) U.S. Cl. ..... 123/198 R

(58) Field of Classification Search ..... 123/198 R, 123/DIG. 8

See application file for complete search history.

(56) References Cited

U.S. PATENT DOCUMENTS 4,531,379 A * 7/1985 Diefenthaler, Jr. ..... 123/DIG. 8
4,611,466 A 9/1986 Keedy
5,301,645 A 4/1994 Ball et al.
7,216,480 B2 * 5/2007 Suzuki et al. ..... 60/285

FOREIGN PATENT DOCUMENTS

| | | |
|---|---|---|
| DE | A 19953940 | 5/2000 |
| FR | 1463799 | 7/1966 |
| FR | A 1546571 | 10/1968 |
| JP | A 57-76263 | 5/1982 |
| JP | A 11-294177 | 10/1999 |

* cited by examiner

*Primary Examiner*—Noah P. Kamen
(74) *Attorney, Agent, or Firm*—Oliff & Berridge, PLC

(57) ABSTRACT

A vehicular accessories drive apparatus includes a main engine, a subsidiary engine, and vehicular accessories that are driven by the main engine or the subsidiary engine. Furthermore, a fuel consumption predicting portion predicts an amount of fuel that is consumed in order for the main engine to drive the vehicular accessories during operation of the engine, and an amount of fuel that is consumed in order for the subsidiary engine to drive the vehicular accessories. An electromagnetic clutch carries out the switching between driving force sources so that the vehicular accessories are driven by the subsidiary engine if the predicted fuel consumption of the main engine is greater than the predicted fuel consumption of the subsidiary engine, and so that the vehicular accessories are driven by the main engine if the predicted fuel consumption of the main engine is less than or equal to the predicted fuel consumption of the subsidiary engine.

11 Claims, 5 Drawing Sheets

VEHICULAR ACCESSORY DRIVING APPARATUS

INCORPORATION BY REFERENCE

The disclosure of Japanese Patent Application No. 2003-349755 filed on Oct. 8, 2003 including the specification, drawings and abstract is incorporated herein by reference in its entirety.

BACKGROUND OF THE INVENTION

1. Field of the Invention

The invention relates to a vehicular accessory driving apparatus and, more particularly, to a vehicular accessory driving apparatus provided in a vehicle that has a plurality of engines.

2. Description of the Related Art

Japanese Patent Application Laid-Open Publication No. 57-76263 (pp. 2–4, FIG. 2) describes a vehicular engine arrangement that includes a main engine for driving the vehicle, and a subsidiary engine for starting and restarting the main engine and driving accessories, such as an alternator and the like (hereinafter, referred to as "auxiliary engine").

The auxiliary engine drives accessories substantially all the time except the time of starting the main engine and the time of restarting the main engine. Therefore, during normal running of the vehicle, both the main engine and the auxiliary engine are operated. Specifically, the main engine drives the vehicle, and the auxiliary engine drives accessories.

In the case where the vehicle is driven by the main engine and the accessories are driven by the auxiliary engine, however, the amount of fuel consumed by the vehicle as a whole may become larger than in the case where the vehicle and the accessories are driven solely by the main engine. This is because operation of the auxiliary engine adds to the mechanical friction and the like. That is, if the amount of fuel consumed in the form of the friction loss and the like of the auxiliary engine is larger than the amount of reduction in the fuel consumption that is achieved by the auxiliary engine replacing the main engine in driving the accessories, the fuel consumption of the vehicle as a whole is larger than if the vehicle and the accessories are driven solely by the main engine.

SUMMARY OF THE INVENTION

The invention has been accomplished in order to solve the aforementioned problems. It is an object of the invention to provide a vehicular accessory driving apparatus capable of reducing the fuel consumption of a vehicle as a whole.

In a first aspect of the invention, a vehicular accessory driving apparatus includes a main engine that drives a vehicle, an auxiliary engine having a smaller displacement than the main engine, and a vehicular accessory that is driven by the main engine or the auxiliary engine. Furthermore, a fuel consumption predictor device is provided which calculates a first predicted fuel amount that is predicted to be consumed by the main engine in order to drive the vehicular accessory if the vehicular accessory is driven by the main engine during an operation of the main engine, and a second predicted fuel amount that is predicted to be consumed by the auxiliary engine if the vehicular accessory is driven by the auxiliary engine. A switching device is provided which carries out switching between driving force sources so that the vehicular accessory is driven by the auxiliary engine if the first predicted fuel amount is greater than the second predicted fuel amount, and so that the vehicular accessory is driven by the main engine if the first predicted fuel amount is less than or equal to the second predicted fuel amount.

According to the first aspect of the invention, if the second predicted fuel amount predicted to be consumed by the auxiliary engine if the vehicular accessory is driven by the auxiliary engine is less than the first predicted fuel amount predicted to be consumed by the main engine in order to drive the vehicular accessory, the switching device carries out the switching between the driving force sources so that the vehicular accessory is driven by the auxiliary engine. Conversely, if the second predicted fuel amount is greater than or equal to the first predicted fuel amount, the switching between the driving force sources is carried out so that the vehicular accessory is driven by the main engine. Therefore, of the main engine and the auxiliary engine, the engine whose fuel consumption is less can be used to drive the vehicular accessory.

According to the first aspect, it is possible to provide a vehicular accessory driving apparatus capable of reducing the fuel consumption of a vehicle as a whole.

In the first aspect, the switching device may include a driving force on/off device that permits and prohibits transfer of driving force between the main engine and the vehicular accessory, and a control device that controls the driving force on/off device so that the transfer of driving force between the main engine and the vehicular accessory is prohibited if the vehicular accessory is driven by the auxiliary engine, and so that the transfer of driving force between the main engine and the vehicular accessory is permitted if the vehicular accessory is driven by the main engine. Therefore, the driving force on/off device is controlled by the control device so that the transfer of driving force between the main engine and the vehicular accessory is prohibited if the vehicular accessory is driven by the auxiliary engine, and so that the transfer of driving force between the main engine and the vehicular accessory is permitted if the vehicular accessory is driven by the main engine. Hence, it becomes possible to switch between the driving force sources for driving the vehicular accessory in accordance with the fuel consumption of the main engine and the fuel consumption of the auxiliary engine.

In the first aspect, the driving force on/off device may be an electromagnetic clutch.

In the first aspect, the auxiliary engine may be stopped if the vehicular accessory is driven by the main engine. This construction makes it possible to further reduce the fuel consumption.

In a second aspect of the invention, a vehicular accessory driving apparatus includes a main engine that drives a vehicle, an auxiliary engine having a smaller displacement than the main engine, and a vehicular accessory that is driven by the main engine or the auxiliary engine. In the apparatus, an engine specification of the auxiliary engine is set so that an amount of fuel consumed by the auxiliary engine if the auxiliary engine is caused to output a minimum driving force that is needed in order to drive the vehicular accessory is less than an amount of fuel consumed by the main engine in order to cause the main engine to output the minimum driving force during an operation of the main engine.

According to the second aspect of the invention, the engine specification of the auxiliary engine is set so that the amount of fuel consumed by the auxiliary engine for the friction loss of the auxiliary engine and the minimum driving of the vehicular accessory becomes less than the amount of fuel consumed by the main engine for the minimum driving of the vehicular accessory.

Therefore, according to the second aspect, it is possible to provide a vehicular accessory driving apparatus capable of reducing the fuel consumption of a vehicle as a whole.

In general, the indicated thermal efficiency can be considered constant with respect to the engine output, and therefore the engine output and the fuel consumption have a linear relationship. Furthermore, the friction loss is substantially constant with respect to increases in the engine output if the engine rotation speed is constant.

If the engine specification of the auxiliary engine is set as described above, the indicated thermal efficiency of the auxiliary engine improves as compared with the main engine, so that the proportion of increase of the fuel consumption with respect to an increase in the engine output can be curbed at a low proportion. Therefore, it becomes possible to make the fuel consumption of the auxiliary engine less than that of the main engine if a driving force that is greater than or equal to the minimum driving force is output by the auxiliary engine.

In the second aspect of the invention, the engine specification may be a compression ratio or an expansion ratio. Therefore, the indicated thermal efficiency can be improved by setting the compression ratio or the expansion ratio of the auxiliary engine at an appropriate value.

In the second aspect, a cylinder bore diameter of the auxiliary engine may be set smaller than a cylinder bore diameter of the main engine, and a compression ratio of the auxiliary engine may be set higher than a compression ratio of the main engine.

In the second aspect, an intake valve closing timing of the auxiliary engine may be set at a retarded side.

In the second aspect, an air-fuel ratio of the auxiliary engine may be set at a lean side of an air-fuel ratio of the main engine.

In the second aspect, an EGR rate of the auxiliary engine may be set greater than an EGR rate of the main engine.

In a third aspect of the invention, an vehicular accessory driving apparatus includes a main engine that drives a vehicle, an auxiliary engine having a smaller displacement than the main engine, and a vehicular accessory that is driven by the main engine or the auxiliary engine. Furthermore, fuel consumption prediction means is provided for calculating a first predicted fuel amount that is predicted to be consumed by the main engine in order to drive the vehicular accessory if the vehicular accessory is driven by the main engine during an operation of the main engine, and a second predicted fuel amount that is predicted to be consumed by the auxiliary engine if the vehicular accessory is driven by the auxiliary engine. Switching means is provided for carrying out switching between driving force sources so that the vehicular accessory is driven by the auxiliary engine if the first predicted fuel amount is greater than the second predicted fuel amount, and so that the vehicular accessory is driven by the main engine if the first predicted fuel amount is less than or equal to the second predicted fuel amount.

According to the third aspect of the invention, it is possible to provide a vehicular accessory driving apparatus capable of reducing the fuel consumption of a vehicle as a whole.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
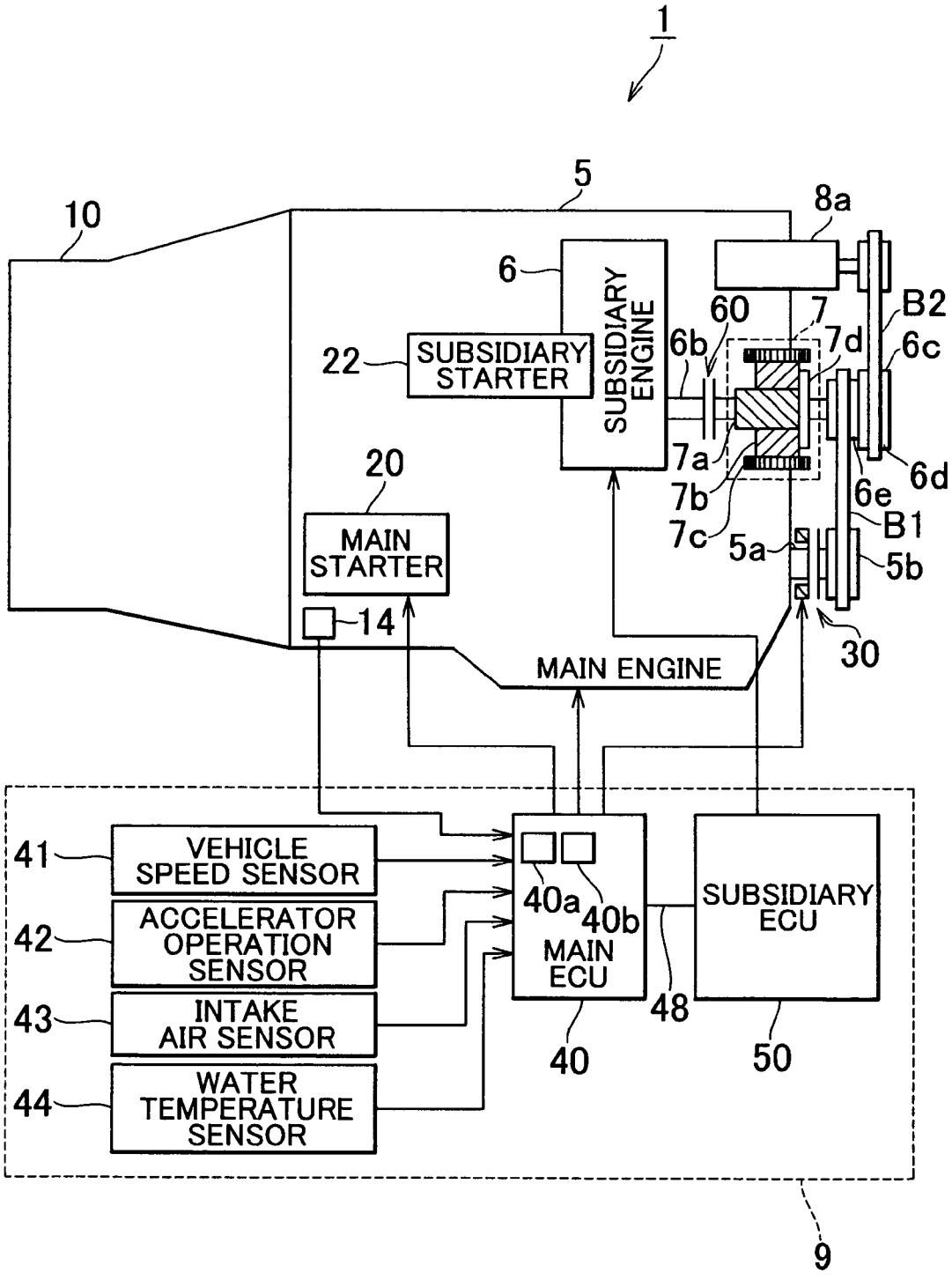
FIG. 1 is a diagram illustrating an overall construction of a vehicular accessory driving apparatus in accordance with a first embodiment of the invention.

Preferred embodiments of the invention will be described in detail hereinafter with reference to the accompanying drawings. In the drawings, the same or comparable elements or portions are represented by the same reference characters.

Firstly, the overall construction of a vehicular accessory driving apparatus 1 will be described with reference to FIGS. 1 to 3.

The vehicular accessory driving apparatus 1 includes a main engine 5 for driving a vehicle, vehicular accessories, and a subsidiary engine (auxiliary engine) 6 for driving the vehicular accessories which has a smaller displacement than the main engine 5. The vehicular accessories include, for example, a water pump 8*a*, an alternator 8*b*, a power steering pump 8*c*, an air compressor 8*d*, etc. (see FIG. 2). Of the accessories, only the water pump 8*a* is shown in FIG. 1 while the others are omitted, for the sake of simple illustration.

The vehicular accessory driving apparatus 1 further includes a planetary gear unit 7 that amplifies the driving force of the subsidiary engine 6, a belt B1 for transfer of driving force between the subsidiary engine 6 and the main engine 5, and a belt B2 for transfer of driving force between the subsidiary engine 6 and the various vehicular accessories.

Figure 2:
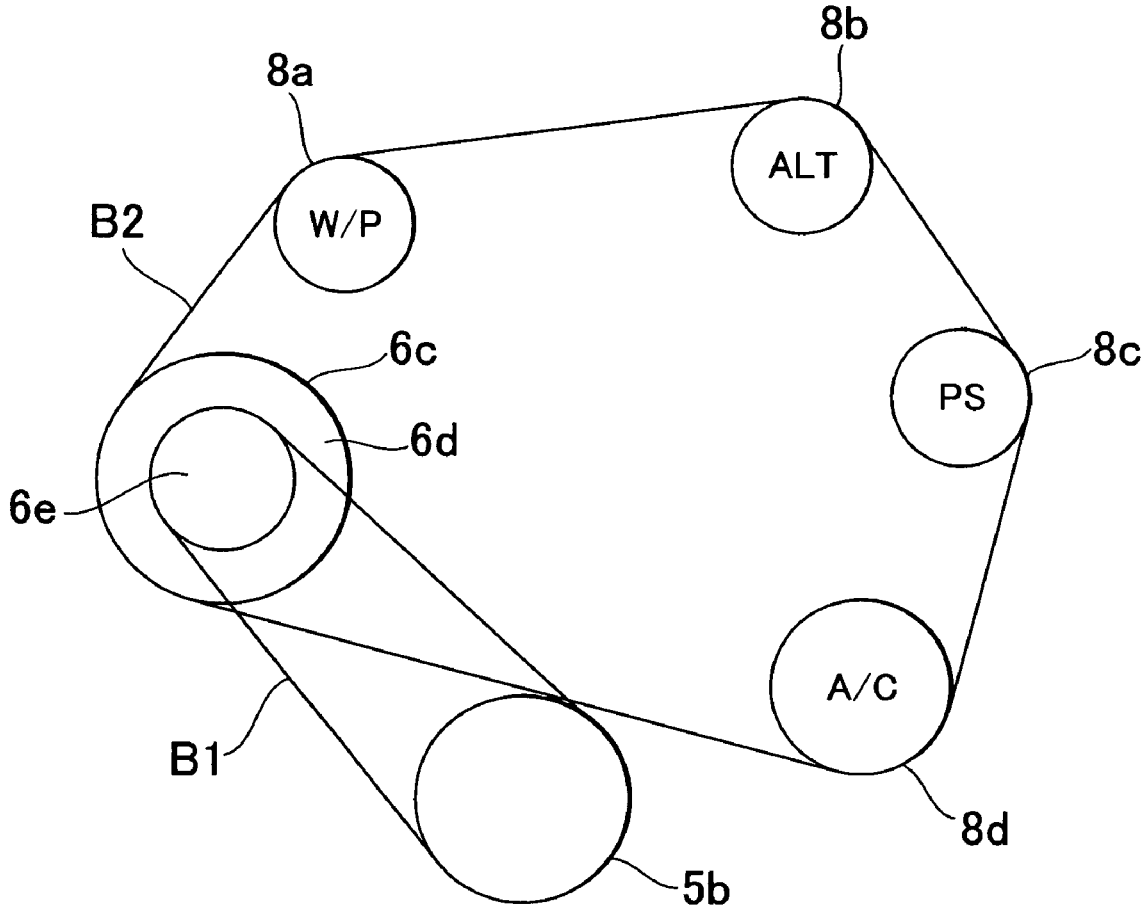
FIG. 2 is a diagram illustrating an arrangement of accessories in the vehicular accessory driving apparatus of the first embodiment.

FIG. 2 illustrates connections of vehicular accessories, that is, the water pump (W/P) 8*a*, the alternator (ALT) 8*b*, the power steering pump (PS) 8*c* and the air compressor (A/C) 8*d*, with the subsidiary engine 6 and the main engine 5. As illustrated in FIG. 2, the belt B2 is looped around pulleys of the water pump 8*a*, the alternator 8*b*, the power steering pump 8*c* and the air compressor 8*d* as well as a large-diameter pulley 6*d*. Therefore, as the large-diameter pulley 6*d* is rotated by the main engine 5 or the subsidiary engine 6, the pulleys connected to vehicular accessories are rotated, so that the vehicular accessories are driven.

The vehicular accessory driving apparatus 1 further includes an electromagnetic clutch 30 that is provided on a crankshaft 5*a* of the main engine 5 and that accomplishes and discontinues the transfer of driving force of the main engine 5, an electronic control device 9 that controls the release and engagement of the electromagnetic clutch 30, and a one-way clutch 60 that accomplishes and discontinues the transfer of driving force of the main engine 5 via the planetary gear unit 7.

When the electromagnetic clutch 30 is engaged, the driving force output from the main engine 5 is transferred to the vehicular accessories via the electromagnetic clutch 30, the belt B1 and the belt B2. Conversely, when the electromagnetic clutch 30 is released, the transfer of driving force from the main engine 5 to the vehicular accessories discontinues. In this case, the driving force of the subsidiary engine 6 is transferred to the vehicular accessories via the one-way clutch 60, the planetary gear unit 7 and the belt B2.

Thus, the electromagnetic clutch 30 functions as a driving force on/off means, and the electronic control device 9 functions as a control means. The electromagnetic clutch 30 and the electronic control device 9 function as switching means.

A transmission 10 is connected to the main engine 5. A main starter motor 20 for starting the main engine 5 is disposed at a connecting portion between the main engine 5 and the transmission 10.

The subsidiary engine 6 is, for example, a gasoline engine having a displacement of 100 to 300 cc. The engine specifications of the subsidiary engine 6 are set so as to achieve low friction and high thermal efficiency. The thermal efficiency of the subsidiary engine 6 is set higher than the thermal efficiency of the main engine 5. For example, the engine specifications of the subsidiary engine 6 are set as mentioned below. The following five fashions of setting are mere illustrative, and do not restrict the setting of the subsidiary engine 6 according to the invention.

(1) The bore diameter of the subsidiary engine 6 is set smaller than the bore diameter of the main engine 5, and the compression ratio of the subsidiary engine 6 is set higher than the compression ratio of the main engine 5.

If the bore diameter is set at a reduced value, the distance of flame propagation during combustion reduces and therefore the duration of combustion reduces, so that the knock limit increases. Therefore, the setting of a reduced bore diameter allows the setting of an increased compression ratio. Hence, this setting can make the thermal efficiency of the subsidiary engine 6 higher than the thermal efficiency of the main engine 5.

(2) The bore diameter of the subsidiary engine 6 is set smaller than the bore diameter of the main engine 5, and the displacement of the subsidiary engine 6 is set smaller than the displacement of the main engine 5, and the compression ratio of the subsidiary engine 6 is set higher than the compression ratio of the main engine 5.

If the bore diameter is set at a reduced value, the distance of flame propagation during combustion reduces and therefore the duration of combustion reduces, so that the knock limit increases. Furthermore, a reduced displacement provides an increased S/V ratio (surface volume ratio), and therefore promotes the cooling of the end gas, so that the knock limit further increases. Therefore, the compression ratio can be set high. Hence, this setting can make the thermal efficiency of the subsidiary engine 6 higher than that of the main engine 5. Furthermore, the reduced displacement of the subsidiary engine 6 allows a reduction of the friction of the subsidiary engine 6.

(3) The bore diameter of the subsidiary engine 6 is set smaller than the bore diameter of the main engine 5, and the compression ratio of the subsidiary engine 6 is set higher than the compression ratio of the main engine 5, and the intake valve closing timing of the subsidiary engine 6 is set at a retarded side.

Since this setting can increase the expansion ratio of the subsidiary engine 6 without increasing the actual compression ratio thereof, the thermal efficiency of the subsidiary engine 6 can be made higher than that of the main engine 5.

(4) The bore diameter of the subsidiary engine 6 is set smaller than the bore diameter of the main engine 5, and the compression ratio of the subsidiary engine 6 is set higher than the compression ratio of the main engine 5, and the air-fuel ratio of the subsidiary engine 6 is set at a lean side of the air-fuel ratio of the main engine 5.

Since the compression ratio of the subsidiary engine 6 is set at a higher value, the in-cylinder temperature at the compression top dead center of the subsidiary engine 6 becomes higher. Therefore, the lean limit of the subsidiary engine 6 increases, so that the thermal efficiency of the subsidiary engine 6 can be made higher than that of the main engine 5.

(5) The bore diameter of the subsidiary engine 6 is set smaller than the bore diameter of the main engine 5, and the compression ratio of the subsidiary engine 6 is set higher than the compression ratio of the main engine 5, and the EGR rate of the subsidiary engine 6 is set greater than the EGR rate of the main engine 5.

Since the compression ratio of the subsidiary engine 6 is set at a higher value, the in-cylinder temperature at the compression top dead center of the subsidiary engine 6 becomes higher. Therefore, the EGR limit of the subsidiary engine 6 increases, so that the thermal efficiency of the subsidiary engine 6 can be made higher than that of the main engine 5.

A subsidiary starter motor 22 for starting the subsidiary engine 6 is connected to the subsidiary engine 6 via gears (not shown). The one-way clutch 60 is connected to a crankshaft 6*b* of the subsidiary engine 6, that is, between the subsidiary engine 6 and the planetary gear unit 7.

The one-way clutch 60 is connected to the planetary gear unit 7 that amplifies the driving force transferred from the subsidiary engine 6 via the one-way clutch 60.

The planetary gear unit 7 has a sun gear 7*a*, planetary gears 7*b* disposed around the sun gear 7*a*, a ring gear 7*c* disposed radially outward of the planetary gears 7*b*, and a planetary carrier 7*d* that retains the planetary gears 7*b*.

The crankshaft 6*b* is connected to the sun gear 7*a*. The driving force of the subsidiary engine 6 input to the sun gear 7*a* is amplified in accordance with the gear ratio (reduction gear ratio) of the planetary gear unit 7, and then is output from the planetary carrier 7*d*.

The gear ratio of the planetary gear unit 7 can be expressed as in the following equation:

$$\text{gear ratio} = \frac{1+\rho}{\rho} \tag{1}$$

where $$\rho = \frac{Zs}{Zi},$$

where Zs is the number of teeth of the sun gear 7*a*, and Zi is the number of teeth of the ring gear 7*c*.

In this embodiment, the gear ratio is 6. Therefore, the planetary gear unit 7 amplifies the driving force of the subsidiary engine 6 to six times, and reduces the rotation speed to one sixth. This gear ratio is determined on the basis of the driving force of the subsidiary engine 6, and the like.

The driving force output from the planetary carrier 7*d* is transferred to a subsidiary crank pulley 6*c*. The subsidiary crank pulley 6*c* employed in this embodiment is a double pulley having a large-diameter pulley 6*d* and a small-diameter pulley 6*e* whose diameter is smaller than that of the large-diameter pulley 6*d*.

The small-diameter pulley 6*e* and a main crank pulley 5*b* are connected by the belt B1, whereby driving force is transferred between the small-diameter pulley 6*e* and the main crank pulley 5*b*.

In this embodiment, the pulley ratio between the small-diameter pulley 6*e* and the main crank pulley 5*b* is set at 2.5. However, this pulley ratio is not limited to 2.5.

Figure 3:
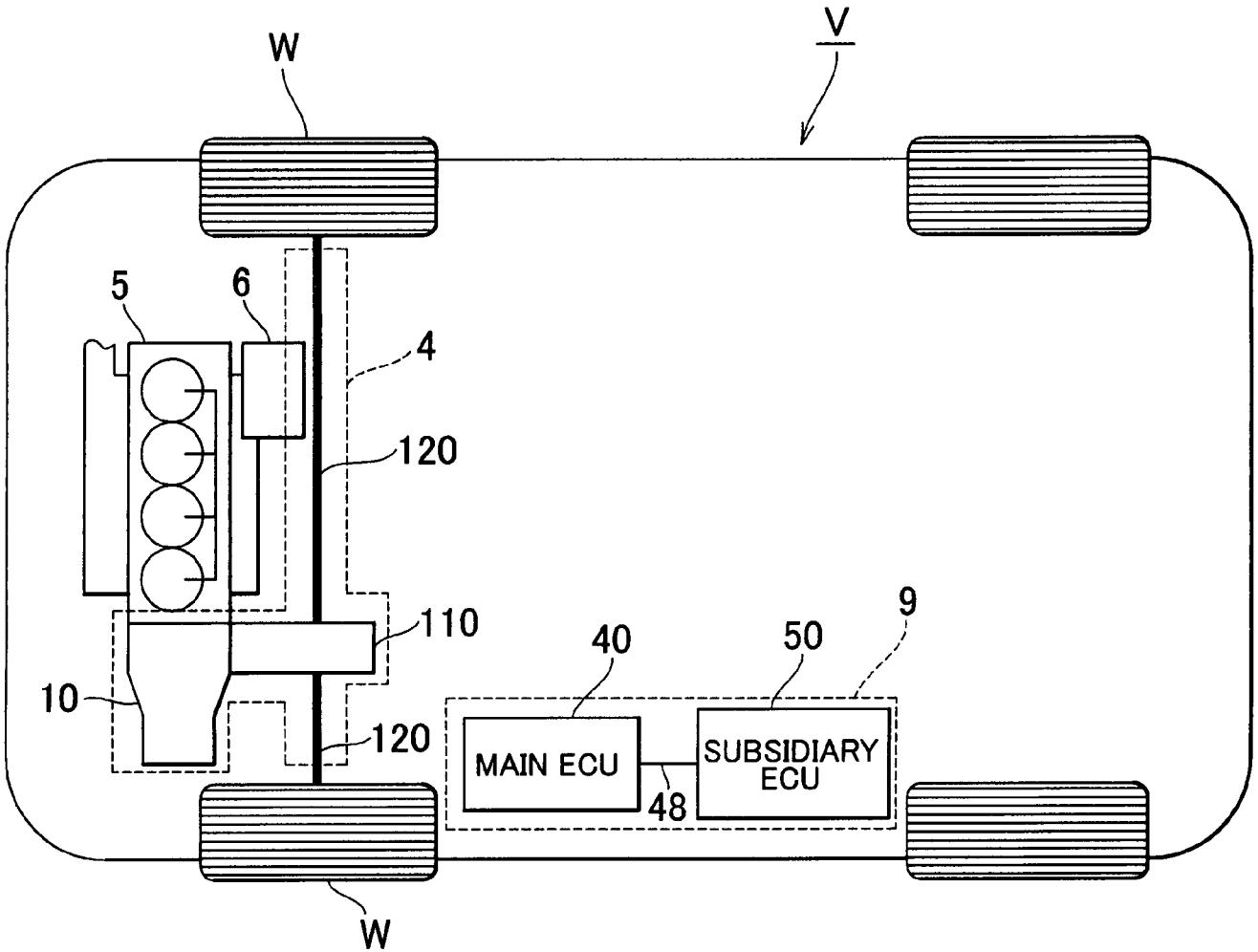
FIG. 3 is a schematic diagram illustrating a construction of a vehicle equipped with the vehicular accessory driving apparatus of the first embodiment.

Referring to FIG. 3, a vehicle V in which the vehicular accessory driving apparatus 1 is installed has a driving force transfer mechanism 4. The driving force transfer mechanism 4 includes the transmission 10 that converts the driving force output from the main engine 5 and outputs converted driving force, a differential 110 that differentiates the rotation speeds of right and left driving wheels W during turn of the vehicle V and that transfers equal driving forces to the two wheels, and drive shafts 120 that transfer the power output from the differential 110 to the driving wheels W.

The driving force output from the main engine 5 is transferred to the driving wheels W via the transmission 10, the differential 110, and the drive shafts 120. As the driving wheels W are driven, the vehicle V is driven.

The electronic control device 9 includes a main engine electronic control unit (hereinafter, referred to as "main ECU") 40 that controls the operation of the main engine 5, and a subsidiary engine electronic control unit (hereinafter, referred to as "subsidiary ECU") 50 that controls the operation of the subsidiary engine 6.

The main ECU 40 is connected to a crank position sensor 14 for detecting the crank position of the main engine 5, a vehicle speed sensor 41 for detecting the speed of the vehicle V, an accelerator operation sensor 42 for detecting the amount of accelerator operation, an intake air sensor 43 for detecting the amount of air taken into the main engine 5, a water temperature sensor 44 for detecting the temperature of cooling water, etc. The main ECU 40 further has a driver circuit for engaging and releasing the electromagnetic clutch 30. The main ECU 40 calculates optimal values of the fuel injection amount, the ignition timing, etc., on the basis of the values output from the various sensors, and then controls the operation of the main engine 5 on the basis of the calculated values.

The main ECU 40 contains therein a microprocessor that executes various calculations, a ROM that stores, for example, programs for causing the microprocessor to execute various operations, a RAM for storing various data, such as results of calculation, a backup RAM whose storage contents are retained owing to a 12V battery (not shown), etc.

In the main ECU 40, various portions are fabricated, including a control portion 40*a* that controls the engagement and release of the electromagnetic clutch 30, a fuel consumption predicting portion 40*b* that predicts an amount of fuel to be consumed in order for the main engine 5 to drive the vehicular accessories (first predicted fuel amount) and the amount of fuel consumed in order for the subsidiary engine 6 to drive the vehicular accessories (second predicted fuel amount), etc. That is, the main ECU 40 functions as a fuel consumption prediction means and a control means for the electromagnetic clutch 30.

The subsidiary ECU 50 is connected to a crank position sensor for detecting the crank position of the subsidiary engine 6, an accelerator operation sensor for detecting the amount of accelerator operation, an air flow meter for detecting the amount of air taken into the subsidiary engine 6, etc.

Similar to the main ECU 40, the subsidiary ECU 50 is formed of a microprocessor, and the like. The subsidiary ECU 50 calculates optimal values of the fuel injection amount, the ignition timing, etc., on the basis of output values from the aforementioned various sensors, and then controls the operation of the subsidiary engine 6 on the basis of the calculated values.

The main ECU 40 and the subsidiary ECU 50 are interconnected by a communication line 48, whereby data exchange therebetween can be accomplished.

Figure 4:
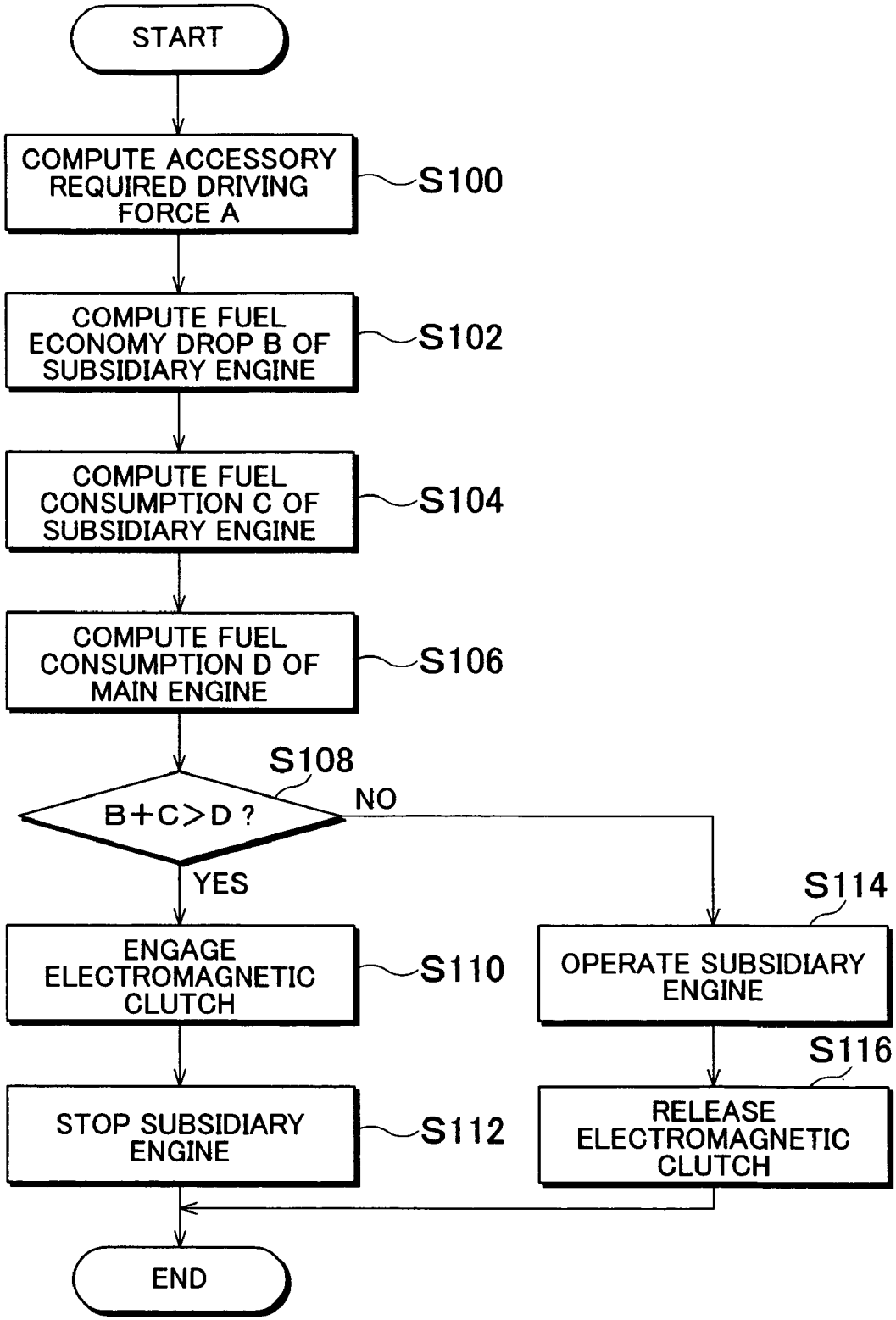
FIG. 4 is a flowchart illustrating a procedure of a drive power source switching process executed by the vehicular accessory driving apparatus of the first embodiment.

An operation of the vehicular accessory driving apparatus 1 will be described with reference to FIG. 4. FIG. 4 is a flowchart illustrating a procedure of a drive power source switching process executed by the vehicular accessory driving apparatus 1. The drive power source switching process is started when the main ECU 40 and the subsidiary ECU 50 are powered on due to the tuning on of an ignition switch of the vehicle, and is executed repeatedly at every predetermined time In step S100, a required driving force A required in order to drive the vehicular accessories is calculated. The required driving force for each vehicular accessory, such as the water pump 8*a*, the alternator 8*b*, the power steering pump 8*c*, the air compressor 8*d*, etc., is calculated on the basis of the state of operation of each vehicular accessory.

Subsequently in step S102, the amount of drop in fuel economy (fuel economy drop) B caused by the driving of the subsidiary engine 6 is calculated. The fuel economy drop B is calculated on the basis of the mechanical friction, the pumping loss, etc. of the subsidiary engine 6.

Figure 5:
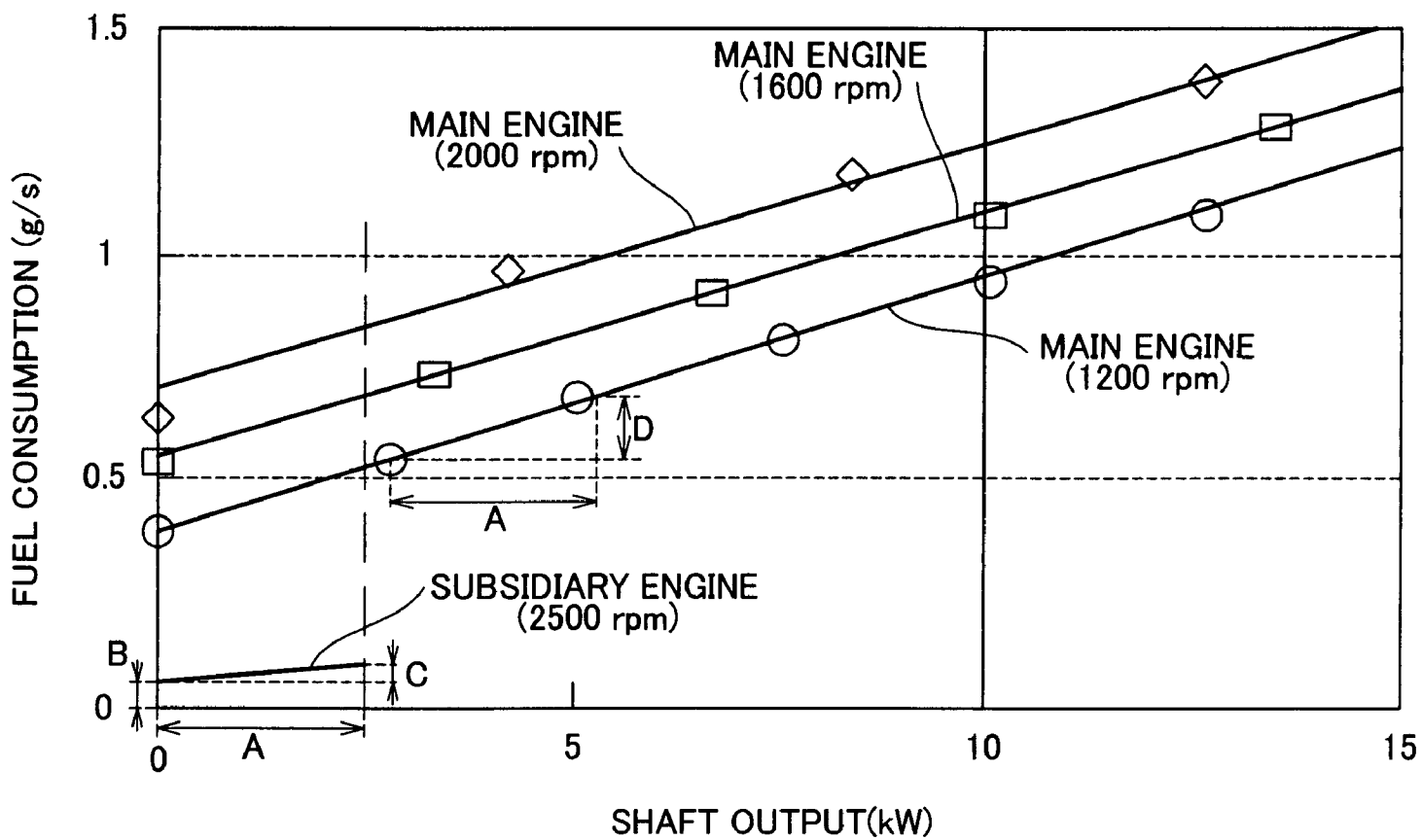
FIG. 5 is a diagram indicating relationships of the shaft output and the fuel consumption of a main engine and a subsidiary engine.

FIG. 5 indicates relationships of the shaft output and the fuel consumption of the main engine and the subsidiary engine. The aforementioned fuel economy drop B corresponds to the intercept of a graph of the subsidiary engine 6 indicated by a solid line in FIG. 5.

Subsequently in step S104, calculation is performed to determine an amount of fuel C that is consumed by the subsidiary engine 6 (fuel consumption C) in order for the subsidiary engine 6 to drive vehicular accessories, that is, in order for the subsidiary engine 6 to output the requested driving force A determined in step S1100.

Subsequently in step S106, calculation is performed to determine the amount D of fuel (first predicted amount of fuel) to be consumed by the main engine 5 in order for the main engine 5 to drive vehicular accessories, that is, in order for the main engine 5 to output the required driving force A determined in step S100 in addition to the driving force for driving the vehicle V (see FIG. 5).

Subsequently in step S108, it is determined whether the sum (second predicted amount of fuel) of the fuel economy drop B regarding the subsidiary engine 6 and the fuel consumption C of the subsidiary engine 6 is greater than the amount D of fuel consumed by the main engine 5 (fuel consumption D), that is, it is determined which one of the subsidiary engine 6 and the main engine 5 to be used to drive the vehicular accessories in order to minimize the fuel consumption.

If it is determined in step S108 that the sum of the fuel economy drop B and the fuel consumption C of the subsidiary engine 6 is greater than the fuel consumption D of the main engine 5, that is, if it is determined that operating the subsidiary engine 6 to drive the vehicular accessories will increase the fuel consumption of the vehicle as a whole, the process proceeds to step S110. Conversely, it is determined in step S108 that the sum of the fuel economy drop B and the fuel consumption C of the subsidiary engine 6 is equal to or less than the fuel consumption D of the main engine 5, that is, if it is determined that operating the subsidiary engine 6 to drive the vehicular accessories will reduce the fuel consumption of the vehicle as a whole, the process proceeds to step S114.

If the answer to step S108 is affirmative, the electromagnetic clutch 30 is engaged in step S110. Subsequently in step S112, the subsidiary engine 6 is stopped. Due to the engagement of the electromagnetic clutch 30, the driving force of the main engine 5 is transferred to the vehicular accessories by the belt B1 and the belt B2 as well as the electromagnetic clutch 30. Therefore, the vehicular accessories are driven by the main engine 5. The connection between the main engine 5 and the subsidiary engine 6 is cut off by the one-way clutch 60, so that co-rotation of the subsidiary engine 6 is prevented and the friction loss is reduced. After that, the process temporarily ends.

If the answer to the step S108 is negative, the subsidiary engine 6 is operated in step S114. Subsequently in step S116, the electromagnetic clutch 30 is released to discontinue the transfer of driving force between the main engine 5 and each vehicular accessory. Therefore, the driving force of the subsidiary engine 6 is transferred to the vehicular accessories via the one-way clutch 60, the planetary gear unit 7 and the belt B2. Thus, the vehicular accessories are driven by the subsidiary engine 6. After that, the process temporarily ends.

According to the embodiment, if the fuel consumption of the subsidiary engine 6 predicted by the fuel consumption predicting portion 40*b* is less than the amount of fuel consumed by the main engine 5 in order to drive the vehicular accessories, the subsidiary engine 6 is operated, and the electromagnetic clutch 30 is released so that the vehicular accessories are driven by the subsidiary engine 6. Conversely, if the fuel consumption of the subsidiary engine 6 is greater than or equal to the amount of fuel consumed by the main engine 5 in order to drive the vehicular accessories, the subsidiary engine 6 is stopped, and the electromagnetic clutch 30 is engaged so that the vehicular accessories are driven by the main engine 5. Thus, one of the main engine 5 and the subsidiary engine 6 that consumes less fuel can be used to drive the vehicular accessories. Therefore, the fuel consumption of the vehicle as a whole can be reduced.

The engine specifications of the subsidiary engine 6, such as the compression ratio thereof, and the like, are set so as to improve the indicated thermal efficiency, as compared with the main engine 5. Therefore, if the subsidiary engine 6 is used to drive the accessories, the fuel consumption can be further reduced.

While a preferred embodiment of the invention has been described above, the invention is not limited to the foregoing embodiment or construction, but may be modified in various manners. For example, instead of the one-way clutch 60, an electronic clutch or the like may be used. Furthermore, the one-way clutch 60 may instead be disposed between the planetary gear unit 7 and the subsidiary crank pulley 6*c*.

What is claimed is:

1. A vehicular accessory driving apparatus comprising:

a main engine that drives a vehicle;

an auxiliary engine having a smaller displacement than the main engine;

a vehicular accessory that is driven by the main engine or the auxiliary engine;

a fuel consumption predictor device that calculates a first predicted fuel amount that is predicted to be consumed by the main engine in order to drive the vehicular accessory if the vehicular accessory is driven by the main engine during an operation of the main engine, and a second predicted fuel amount that is predicted to be consumed by the auxiliary engine if the vehicular accessory is driven by the auxiliary engine; and a switching device that carries out switching between driving force sources so that the vehicular accessory is driven by the auxiliary engine if the first predicted fuel amount is greater than the second predicted fuel amount, and so that the vehicular accessory is driven by the main engine if the first predicted fuel amount is less than or equal to the second predicted fuel amount.

2. The vehicular accessory driving apparatus according to claim 1, wherein the switching device comprises a driving force on/off device that permits and prohibits transfer of driving force between the main engine and the vehicular accessory, and a control device that controls the driving force on/off device so that the transfer of driving force between the main engine and the vehicular accessory is prohibited if the vehicular accessory is driven by the auxiliary engine, and so that the transfer of driving force between the main engine and the vehicular accessory is permitted if the vehicular accessory is driven by the main engine.

3. The vehicular accessory driving apparatus according to claim 2, wherein the driving force on/off device is an electromagnetic clutch.

4. The vehicular accessory driving apparatus according to claim 1, wherein the auxiliary engine is stopped if the vehicular accessory is driven by the main engine.

5. A vehicular accessory driving apparatus, comprising:

a main engine that drives a vehicle;

an auxiliary engine having a smaller displacement than the main engine; and a vehicular accessory that is driven by the main engine or the auxiliary engine, wherein an engine specification of the auxiliary engine is set so that an amount of fuel consumed by the auxiliary engine due to the friction loss in the auxiliary engine and due to an output of a minimum driving force used to drive the vehicular accessory is less than an amount of fuel consumed by the main engine to compensate for an increase in output needed to generate the minimum driving force used to drive the vehicular accessory.

6. The vehicular accessory driving apparatus according to claim 5, wherein the engine specification is a compression ratio or an expansion ratio.

7. The vehicular accessory driving apparatus according to claim 5, wherein a cylinder bore diameter of the auxiliary engine is set smaller than a cylinder bore diameter of the main engine, and a compression ratio of the auxiliary engine is set higher than a compression ratio of the main engine.

8. The vehicular accessory driving apparatus according to claim 7, wherein an intake valve closing timing of the auxiliary engine is set at a retarded side.

9. The vehicular accessory driving apparatus according to claim 7, wherein an air-fuel ratio of the auxiliary engine is set at a lean side of an air-fuel ratio of the main engine.

10. The vehicular accessory driving apparatus according to claim 7, wherein an EGR rate of the auxiliary engine is set greater than an EGR rate of the main engine.

11. A vehicular accessory driving apparatus comprising:

a main engine that drives a vehicle;

an auxiliary engine having a smaller displacement than the main engine;

a vehicular accessory that is driven by the main engine or the auxiliary engine;

fuel consumption prediction means for calculating a first predicted fuel amount that is predicted to be consumed by the main engine in order to drive the vehicular accessory if the vehicular accessory is driven by the main engine during an operation of the main engine, and a second predicted fuel amount that is predicted to be consumed by the auxiliary engine if the vehicular accessory is driven by the auxiliary engine; and switching means for carrying out switching between driving force sources so that the vehicular accessory is driven by the auxiliary engine if the first predicted fuel amount is greater than the second predicted fuel amount, and so that the vehicular accessory is driven by the main engine if the first predicted fuel amount is less than or equal to the second predicted fuel amount.

* * * * *